US005376487A

United States Patent [19]

Ueda

[11] Patent Number: 5,376,487

[45] Date of Patent: Dec. 27, 1994

[54] PHOTOSENSITIVE MEMBER CONTAINING SPECIFIED ARYLAMINE COMPOUND AND ELECTRON-ACCEPTING COMPOUND

[75] Inventor: Hideaki Ueda, Kishiwada, Japan

[73] Assignee: Minolta Camera Kabushiki Kaisha, Osaka, Japan

[21] Appl. No.: 131,395

[22] Filed: Oct. 5, 1993

[30] Foreign Application Priority Data

Oct. 7, 1992 [JP] Japan ..... 4-268552

[51] Int. Cl.[5] ..... G03G 5/047

[52] U.S. Cl. ..... 430/59; 430/900

[58] Field of Search ..... 430/59, 900

[56] References Cited

U.S. PATENT DOCUMENTS 4,535,042 8/1985 Kitayama et al. ..... 430/59 X
4,559,287 12/1985 McAneney et al. ..... 430/59
4,563,408 1/1986 Lin et al. ..... 430/59
4,599,286 7/1986 Limburg et al. ..... 430/59
4,818,653 4/1989 Wiedemann et al. ..... 430/59

FOREIGN PATENT DOCUMENTS 127407 5/1993 Japan ..... 430/59

*Primary Examiner*—Roland Martin
*Attorney, Agent, or Firm*—Burns, Doane, Swecker & Mathis

[57] ABSTRACT

The present invention provides a laminated-type photosensitive member having a photosensitive layer comprising;

a charge generating layer and a charge transporting layer having a layer thickness of 25 μm or more and containing an arylamine compound as a charge transporting material and an electron-accepting compound having an electron; affinity of 0.85-1.0 eV on an electrically substrate.

8 Claims, 1 Drawing Sheet

PHOTOSENSITIVE MEMBER CONTAINING SPECIFIED ARYLAMINE COMPOUND AND ELECTRON-ACCEPTING COMPOUND

BACKGROUND OF THE INVENTION

1. Field of the Invention

The present invention relates to a photosensitive member having a photosensitive layer composed of a charge generating layer and a charge transporting layer. Particularly, the present invention relates to a photosensitive member having a thick photosensitive layer which is improved in sensitivity, repetition-properties and life.

2. Description of the Prior Art

In an electrophotographic system, copy images are formed by various kinds of methods. For example, the surface of a photosensitive member is charged and irradiated to form electrostatic latent images thereon, the electrostatic latent images are developed by a developer to be made visible and then the developed electrostatic latent images are fixed directly onto the photosensitive member (referred to as a direct method). In other method, developed electrostatic latent images on a photosensitive member which are made visible by a developer are transferred to a copy paper arid then, the transferred images are fixed on the paper (referred to as a powder transferring method). In another method, electrostatic latent images on a photosensitive member are transferred onto a copy paper, the transferred electrostatic latent images are developed by a developer and then fixed on the copy paper (referred to as an electrostatic latent image transferring method).

Known photosensitive materials for forming a photosensitive layer include inorganic photoconductive materials such as selenium, cadmium sulfide or zinc oxide.

These photoconductive materials have many advantages such as low loss of charges in the dark, an electrical charge which can be rapidly dissipated with irradiation of light and the like. However they have disadvantages. For example, a photosensitive member based on selenium is difficult to produce, has high production costs and is difficult to handle due to inadequate resistivity to heat or mechanical impact. A photosensitive member based on cadmium sulfide has defects such as its unstable sensitivity in highly humid environment and loss of stability with time because of the deterioration of dyestuffs, added as a sensitizer, by corona charge and fading with exposure.

Many kinds of organic photoconductive materials such as polyvinylcarbazole and the like have been proposed. These organic photoconductive materials have superior film-forming properties, are light in weight, etc., but inferior in sensitivity, durability and environmental stability compared with the aforementioned inorganic photoconductive materials.

Various studies and development have been in progress to overcome the above noted defects and problems. It has been proposed that charge generating function and charge transporting function are divided in a photosensitive layer, so that a function-divided photosensitive member which contains a charge generating material and a charge transporting material has been provided.

Such a function-divided photosensitive member has high productivity and low costs, since they can be prepared by a coating method, and a suitably selected charge generating material can freely control a region of photosensitive wavelength.

However such a function-divided photosensitive member has following problems; an initial surface potential is lowered, a residual potential increases and fogs are liable to be formed in copy images when used repeatedly. It is thought that these problems are brought about by a number of traps in a photosensitive layer, which are caused by interface conditions between a charge generating material and a binder resin or a charge transporting material and a binder resin, a barrier having an energy level, impurities contained in materials, deterioration of materials caused by corona discharge, exposure light, erasing light and the like, absorption of oxidizing gasses such as ozone and NOx, and deterioration of materials caused by the absorption. Therefore generated charges are thought to be trapped before they are combined with charges on surface.

Under the above circumstances, an aryl amine compound is proposed, because it has excellent performances as a charge transporting material, such as few traps, high mobility and low deterioration.

However mechanical properties are not satisfactory. There is limitation in durability. A photosensitive layer is worn under load such as friction with toner or paper, so that a thickness of a photosensitive layer decreases. Such a tendency is remarkable with respect to an organic photosensitive member. The decrease of layer thickness causes the lowering of chargeability. When the layer thickness becomes thinner than a specified thickness, the photosensitive member can not be put to use. Because an organic photosensitive member is poor in durability compared with an inorganic photosensitive member of selenium or amorphous silicone type, it has been applied to a low-speed copying machine. However, as it has been researched and developed recently that copying speed is made high, an organic photosensitive member for a high or middle speed copying machine is desired. The inventors have studied how to improve durability by use of excellent characteristics of an arylamine compound. It has been found that changes in electrical properties caused by wearing, in particular, lowering of chargeability can be prevented by making a photosensitive layer thick compared with a conventional layer thickness, in more detail, by making a charge transporting layer thicker.

However with respect to a conventional photosensitive member, when a charge transporting layer is made thicker, the number of traps increases in the charge transporting layer, so that residual potential is accumulated increasingly when used repeatedly.

In order to prevent above mentioned harmful influences, it has been studied that an electron-accepting compound is added into a charge transporting layer.

However unless a specified electron-accepting compound is used, a residual potential can not be controlled satisfactorily, and a surface potential and sensitivity are lowered after repetition use.

Further as an organic photosensitive member has been also applied to a laser printer and facsimile recently, higher image-reliability and repetition stability are required.

SUMMARY OF THE INVENTION

The object of the present invention is to provide a photosensitive member of laminated-type excellent in sensitivity and durability, which is improved with respect to lowering of surface potential and increase of residual potential.

The present invention relates to a laminated-type photosensitive member having a photosensitive layer comprising;

a charge generating layer and a charge transporting layer having a layer thickness of 25 μm or more and containing an arylamine compound as a charge transporting material and an electron-accepting compound having an electron affinity of 0.85–1.0 eV on an electrically substrate.

DETAILED DESCRIPTION OF THE INVENTION

Figure 1:
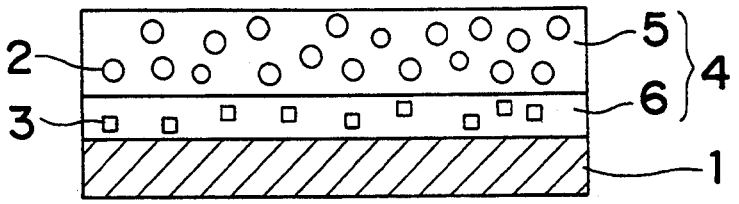
FIG. 1 is a schematic sectional view of a function-divided photosensitive member having a photosensitive layer laminated on an electrically conductive substrate.

The present invention relates to a laminated-type photosensitive member having a photosensitive layer comprising;

a charge generating layer and a charge transporting layer having a layer thickness of 25 μm or more and containing an arylamine compound as a charge transporting material and an electron-accepting compound having electron affinity of 0.85–1.0 eV on an electrically substrate.

According to the present invention, a specified charge transporting material and a specified arylamine compound are added to give a photosensitive member excellent in sensitivity and being improved with respect to lowering of surface potential and increase of residual potential, even though used repeatedly.

The present invention uses an arylamine compound which works as a charge transporting material. A preferable arylamine compound is the one represented by the following general formula [I];

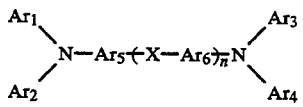

[I]

In the above formula [I], $Ar_1$–$Ar_4$ represent respectively an aryl group, an aralkyl group, a biphenyl group or a heterocyclic group, each of which may have a substituent.

$Ar_5$ and $Ar_6$ represent respectively an arylene group, a biphenylene group or a fluorene bivalent group.

X represents —O—, —S—, —$NR_1$—, —$CR_2R_3$—. $R_1$ represents a hydrogen atom, an alkyl group, an aralkyl group, an aryl group, a biphenyl group or a heterocyclic group; $R_2$ and $R_3$ represents respectively a hydrogen atom, an alkyl group, an aralkyl group or an aryl group.

The letter "n" represents 0 or 1.

Among arylamine compounds represented by the formula [I], a compound represented by the following formula [II] or [III].

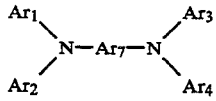

[II]

In the formula [II], $Ar_1$–$Ar_4$ are the same as those in the formula [I]. $Ar_7$ represents an arylene group, a biphenylene group or a fluorene bivalent group, each of which may have a substituent. The substituent is exemplified by an alkyl group, an alkoxy group or a halogen atom.

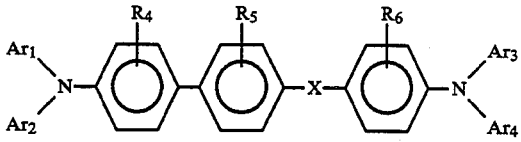

[III]

In the formula [III], $Ar_1$ -$Ar_4$ and X are the same as those in the formula [I]. $R_4$–$R_6$ represent respectively a hydrogen atom, an alkyl group, an alkoxy group or a halogen atom.

In particular, the arylamine compound represented by the formula [III] is preferable from the view point of sensitivity and mobility. Concretely, arylamine compounds of the formula [III] disclosed in Japanese Patent Application No. Hei3-205201, Japanese Patent Application No. Hei3-269283 or Japanese Patent Application No. Hei3-270847 can be used.

The arylamine compound of the present invention may be used in combination with other charge transporting materials such as a styryl compound and a hydrazone compound.

An electron-accepting compound used with the arylamine compound is the one having an electron affinity of 0.85–1.0 eV. Preferable electron affinity is 0.88–0.95 eV. If the electron affinity is smaller than 0.85 eV, satisfactory effects can not be achieved. The addition of a large amount of the compound causes high deterioration of charge-keeping ability and sensitivity. If the electron affinity is larger than 1.0 eV, mere addition of very small amount of the compound brings about deterioration of charge-keeping ability and sensitivity.

In the present invention, a value of electron affinity is quoted from Louis Meites and Petr Zuman, "Electrochemical Pata", John Wiley & Sons. A not-clear value of electron affinity is calculated on the basis of maximum absorption wavelength ($\lambda_{max}$) of its charge-transfer complex with a charge transporting material.

Almost no arylamine compound absorbs lights in the region of visible lights. The arylamine compound, however, forms a charge-transfer complex with an electron-accepting compound. A new absorption spectrum appears in the region of longer wavelength. When an electron-accepting compound having electron affinity of 0.85–1.0 eV is added, a maximum absorption ($\lambda_{max}$) appears in the region between 480–550 nm.

It is thought that when the charge-transfer complex is irradiated by lights corresponding to the absorption region of the complex, a little amount of carriers (pairs of positive holes and electrons) which can move are generated, with the result that these carriers neutralize space-charges which can not move to control a residual potential.

Therefore the electron-accepting compounds should be the one having an electron affinity suitable for some carriers to generate. If the charge-transfer complex absorbs lights so much in a visible region, deterioration of sensitivity is remarkable. Accordingly more preferable electron-accepting compound is the one which forms a charge-transfer complex with an arylamine compound to show a maximum absorption ($\lambda_{max}$) in the region of 500–530 nm.

An addition amount of the electron accepting compound is 1–10 wt %, more preferably 2–8 wt % to the arylamine compound. If the amount is less than 1 wt %, the effects of the present invention can not be achieved. If the amount is more than 10 wt %, bad influences such as deterioration of sensitivity and increase of dark-decreasing ratio are brought about.

A form of a photosensitive member used in the present invention is a laminated-type photosensitive member having a charge generating layer and a charge transporting layer on an electrically conductive substrate.

For example, FIG. 1 shows a laminated-type photosensitive member having a function-divided photosensitive layer (4) formed on an electrically conductive substrate (1) in which a charge transporting layer (5) containing a charge transporting material (2) is laminated on a charge generating layer (6) containing a charge generating material (3). In the present invention, both the charge transporting layer (5) and the charge generating layer (6) form the photosensitive layer (4).

Figure 2:
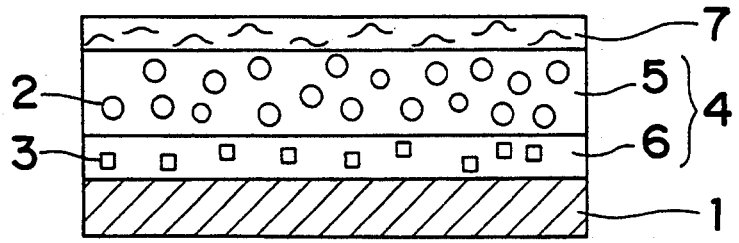
FIG. 2 is a schematic sectional view of a function-divided photosensitive member having a photosensitive layer and a surface protective layer on an electrically conductive substrate in this order.
Figure 3:
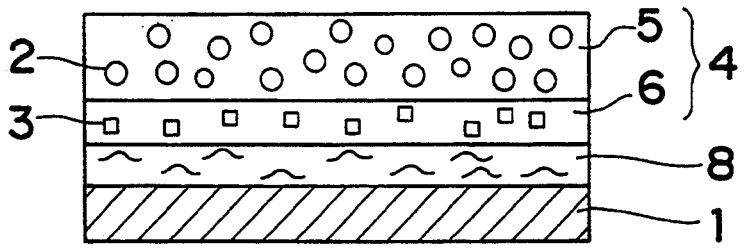
FIG. 3 is a schematic sectional view of a function-divided photosensitive member having an intermediate layer and a photosensitive layer on an electrically conductive substrate in this order.

A photosensitive member may have a surface protective layer (7) on the photosensitive layer (4) as shown in FIG. 2 or may have an intermediate layer (8) between the electrically conductive substrate (1) and the photosensitive layer (4) as shown in FIG. 3. The formation of the intermediate layer between the electrically conductive substrate and the photosensitive layer effects to improve protection of the electrically conductive substrate and charge-injection from the electrically conductive substrate to the photosensitive layer as well as adhesivity of the photosensitive layer to the electrically conductive substrate and coatability.

It is explained hereinafter how to prepare the laminated-type photosensitive member shown in FIG. 1. A charge generating material is deposited in vacuum on an electrically substrate, or a charge generating material is dissolved in an adequate solvent, if necessary, together with a binder resin to apply onto an electrically conductive substrate. Thus a charge generating layer is formed. Then a solution containing a charge transporting material and a binder resin is applied onto the charge generating layer and dried to form a charge transporting layer.

The electron-accepting compound having electron affinity of 0.85–1.0 eV is preferably contained in the charge transporting layer in the laminated photosensitive member.

The arylamine compound is contained at a content of 0.2–2 parts by weight, preferably 0.3–1.3 parts by weight on the basis of 1 part by weight of the binder resin in the charge transporting layer. The electron-accepting compound having electron affinity of 0.85–1.0 eV is added at a content of 1–10% by weight, preferably 2–8% by weight to the arylamine compound. If the content of the arylamine compound is less than 1% by weight, increase of residual potential caused by repetition use can not be restrained. The addition of more than 10% by weight results in deterioration of initial surface potential.

A thickness of the charge generating layer is 4 μm or less, preferably 2 μm or less. A thickness of the charge transporting layer is 25–60 μm, preferably 30–50 μm.

When a layer thickness is adjusted within the range as above mentioned, durability of a photosensitive member can be improved. Further, when both a specified charge transporting material and a specified electron-accepting compound are used, the problems caused by a thick layer as described in the prior art can be solved.

Accordingly a photosensitive member of the present invention can be also applied to a high or middle speed copying machine in which a circumferential speed of the photosensitive member is 250 mm/sec or more, in particular 300 mm/sec or more. A conventional organic photosensitive member could not be applied to such a high or middle speed copying machine.

Known binder resin can be used for forming a photosensitive layer so far as it is insulating, such as a thermoplastic resin, a thermosetting resin, a photocuring resin and a photoconductive resin.

The suitable binder resins are exemplified with no significance in restricting the embodiments of the present invention by thermoplastic resins such as saturated polyesters, polyamides, acrylic resins, ethylene-vinyl acetate copolymers, ion cross-linked olefin copolymers (ionomers), styrenebutadiene block copolymers, polycarbonates, vinyl chloride-vinyl acetate copolymers, cellulose esters, polyimides and styrols; thermosetting resins such as epoxy resins, urethane resins, silicone resins, phenolic resins, melamine resins, xylene resins, alkyd resins and thermosetting acrylic resins; photocuring resins; photoconductive resins such as poly-vinyl carbazole, polyvinyl pyrene, polyvinyl anthracene, polyvinylpyrrole. Any of these resins can be used singly or in combination with other resins. It is desirable that these electrically insulating resins have a volume resistance of $1\times10^{12}$ Ωcm or more when measured singly.

Charge generating materials used for forming the photosensitive layer are exemplified by organic substances such as bisazo dyes, triarylmethane dyes, thiazine dyes, oxazine dyes, xanthene dyes, cyanine coloring agents, styryl coloring agents, pyrylium dyes, azo dyes, quinacridone pigments, indigo pigments, perylene pigments, polycyclic quinone pigments, bisbenzimidazole pigments, indanthrone pigments, squalylium pigments, azulene coloring agents and phthalocyanine pigments; and inorganic substances such as selenium, selenium-tellurium, selenium-arsenic, cadmium sulfide, cadmium selenide, zinc oxide and amorphous silicon. Any other material is also usable insofar as it generates charge carriers very efficiently upon absorption of light.

Charge generating materials which can be applied to a deposition method in vacuum are exemplified by phthalocyanines such as metal-free phthalocyanines, titanyl phthalocyanines and aluminum-chlorophthalocyanines.

EXAMPLES

EXAMPLE 1

A trisazo pigment represented by the following chemical formula:

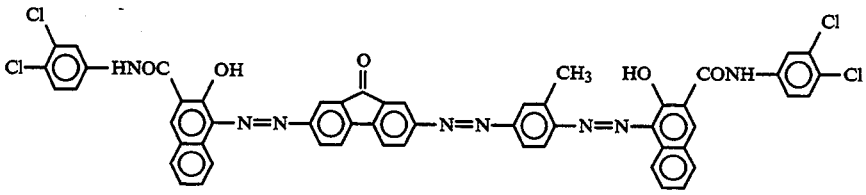

of 10 parts by weight, cyclohexanone of 150 parts by weight and polyvinylbutyral resin (6000-C; matte by Denki Kagaku Kogyo K.K.) of 10 parts by weight were added to cyclohexanone of 400 parts by weight. The obtained solution was subjected to a pulverizing and dispersing treatment in a sand-grinding mill.

The resultant dispersion solution was applied by a dipping method onto an aluminum drum (outer diameter: 80 m/m, length: 340 mm, thickness: 1.0 mm) the surface of which was planished. Thus a charge generating layer having a layer thickness of 0.2 μm was formed after dried.

Then an arylamine compound represented by the following chemical formula:

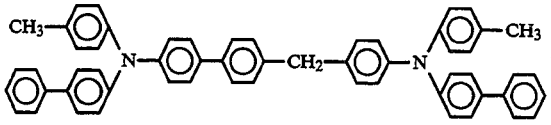

of 100 parts by weight, polycarbonate resin (K-1300; made by Teijin Kasei K.K.) of 100 parts by weight, and an electron-accepting compound having an electron affinity of 0.94 eV represented by the following chemical formula;

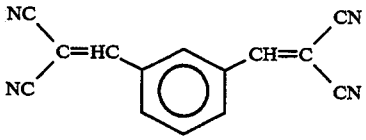

of 4 parts by weight were dissolved in a mixed solvent of 1,4-dioxane and tetrahydrofuran. The obtained solution was applied onto the charge generating layer by a dipping method so that a charge transporting layer having a thickness of 30 μm might be formed after dried at 125° C. for 30 minutes.

A maximum absorption wavelength ($\lambda_{max}$) of the charge transfer complex was 520 nm.

EXAMPLE 2

A photosensitive member was prepared in a manner similar to Example 1 except that a compound having an electron affinity of 0.91 eV represented by the following chemical formula:

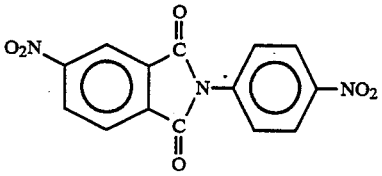

of 5 parts by weight was added instead of the electron accepting compound used in Example 1.

A maximum absorption wavelength ($\lambda_{max}$) of the charge transfer complex was 505 nm.

EXAMPLE 3

A photosensitive member was prepared in a manner similar to Example 1 except that a compound having an electron affinity of 0.96 eV represented by the following chemical formula:

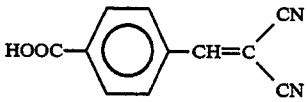

of 3 parts by weight was added instead of the electron accepting compound used in Example 1.

A maximum absorption wavelength ($\lambda_{max}$) of the charge transfer complex was 530 nm.

COMPARATIVE EXAMPLES 1-5

Photosensitive members were prepared in a manner similar to Example 1 except that electron-accepting materials and addition amount thereof were as follows in Table 1.

TABLE 1

| COMPARATIVE EXAMPLES | ELECTRON ACCEPTING MATERIAL | ADDITION AMOUNT (pbw) | ELECTRON AFFINITY (eV) |
|---|---|---|---|
| 1 | n-dinitrobenzene | 10 | 0.31 |
| 2 | p-benzoquinone | 4 | 0.7 |
| 3 | trinitrofluorenone | 3 | 1.1 |
| 4 | chloranil | 1 | 1.37 |
| 5 | — | none | |

EXAMPLE 4

A bisazo pigment represented by the following chemical formula:

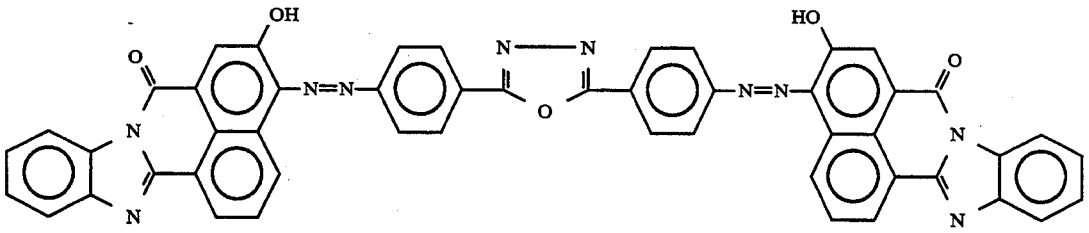

of 1 part by weight, butyral resin (BX-1; made by Sekisui Kagaku K.K.) of 1 part by weight and 4-methoxy-4-methylpentanone-2 of 98 parts by weight were mixed and dispersed in a sand-grinding mill to give a coating solution for forming a photosensitive layer.

The resultant solution was applied by a dipping method onto an aluminum drum (outer diameter: 80 m/m, length: 340 mm, thickness: 1.0 mm) the surface of which was planished. Thus a charge generating layer having a layer thickness of 0.4 μm was formed after dried.

Then an arylamine compound represented by the following chemical formula:

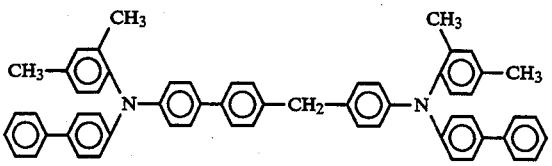

of 70 parts by weight, an aryl amine compound represented by the following chemical formula:

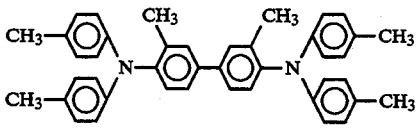

of 30 parts by weight and polycarbonate resin (K-Z; made by Teijin Kasei K.K.) of 100 parts by weight, and 2,7-dinitrofluorenone of 5 parts by weight having electron affinity of 0.9 eV of 5 parts by weight were dissolved in a mixed solvent of 1,4-dioxane and tetrahydrofuran. The obtained solution was applied onto the charge generating layer so that a charge transporting layer having a thickness of 35 μm might be formed after dried at 125° C. for 30 minutes.

A maximum absorption wavelength ($\lambda_{max}$) of the charge transfer complex was 500 nm.

The above obtained photosensitive members were installed in a copying machine (EP-5400; made by Minolta Camera K.K.) available in the market to be subjected to a developing cycle; a charging step (set to a level of −650 V by a scorotron at an initial stage), an exposing step, a developing step, a transferring step, a cleaning step and an erasing step. The cycle was repeated 30000 times to measure a surface potential $V_0(V)$ in the dark at an initial stage and after cycle-repetition, an exposure amount ($E_{\frac{1}{2}}$) (lux.sec) required for the surface potential to be half the value of the initial surface potential, a potential after erased (residual potential) $V_R(V)$) and a decreasing ratio of the surface potential after left in the dark for 1 second ($DDR_1$ (%)). The results were shown in Table 2 (initial stage) and Table 3 (after cycle-repetition). It is understood from Table 2 and Table 3 that a photosensitive member of the present invention has very stable properties.

TABLE 2

| | $V_0(V)$ | $E_{\frac{1}{2}}$(lux. sec) | $V_R(V)$ | $DDR_1$ (%) |
|---|---|---|---|---|
| EX*1 | −650 | 0.7 | −5 | 2.8 |
| EX 2 | −650 | 0.7 | −10 | 2.7 |
| EX 3 | −650 | 0.7 | −10 | 2.8 |
| EX 4 | −650 | 0.9 | −10 | 2.9 |
| CE**1 | −650 | 1.0 | −15 | 3.0 |
| CE 2 | −650 | 0.9 | −15 | 2.8 |
| CE 3 | −650 | 0.7 | −10 | 3.8 |
| CE 4 | −650 | 0.7 | −5 | 4.2 |
| CE 5 | −650 | 0.7 | −10 | 2.8 |

*; EXAMPLE
**; COMPARATIVE EXAMPLE

TABLE 3

| | (after 30000 times of copy) | | | |
|---|---|---|---|---|
| | $V_0(V)$ | $E_{\frac{1}{2}}$(lux. sec) | $V_R(V)$ | $DDR_1$ (%) |
| EX 1 | −645 | 0.9 | −25 | 3.0 |
| EX 2 | −640 | 0.9 | −30 | 3.1 |
| EX 3 | −640 | 1.0 | −35 | 3.5 |
| EX 4 | −635 | 1.2 | −40 | 3.2 |
| CE 1 | −750 | 5.4 | −130 | 3.0 |
| CE 2 | −680 | 3.9 | −90 | 4.5 |
| CE 3 | −530 | 2.5 | −30 | 15.9 |
| CE 4 | −480 | 1.8 | −20 | 20.3 |
| CE 5 | −730 | 4.7 | −110 | 2.3 |

What is claimed is:

1. A laminated-type photosensitive member having a photosensitive layer comprising;

a charge generating layer and a charge transporting layer of 25 μm or more thickness containing a binder resin, an arylamine compound as a charge transporting material of 0.2–2 parts by weight on the basis of one part by weight of the binder resin, and an electron-accepting compound of 1–10 percent by weight to the charge transporting material, said electron accepting compound having an electron affinity of 0.85–1.0 eV, on an electrically conductive substrate.

2. A photosensitive member of claim 1, in which a maximal absorption wavelength of a charge-transfer complex of the arylamine compound with the electron-accepting compound is in the range of 480–550 nm.

3. A photosensitive member of claim 1, in which the arylamine compound is represented by the following general formula [I];

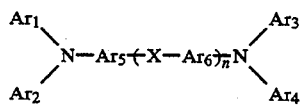

[I]

in which $Ar_1$–$Ar_4$ are respectively an aryl group, an aralkyl group, a biphenyl group or a heterocyclic group, each of which may have a substituent;

$Ar_5$ and $Ar_6$ are respectively an arylene group, a biphenylene group or a fluorene bivalent group, each of which may have a substituent;

X is —O—, —S—, —$NR_1$—, or —$CR_2R_3$— in which $R_1$ is a hydrogen atom, an alkyl group, an aralkyl group, an aryl group, a biphenyl group or a heterocyclic group; $R_2$ and $R_3$ are respectively a hydrogen atom, an alkyl group, an aralkyl group or an aryl group);

the letter "n" is zero or 1.

4. A photosensitive member of claim 1, in which the arylamine compound is represented by the following general formula [II];

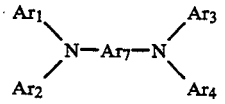

[II]

in which Ar–$Ar_4$ are the same as those in the formula [I] of claim 1; $Ar_7$ is an aryl group, a biphenyl group or a fluorene group, each of which may have a substituent selected from an alkyl group, an alkoxy group or a halogen atom.

5. A photosensitive member of claim 1, in which the arylamine compound is represented by the following general formula [III];

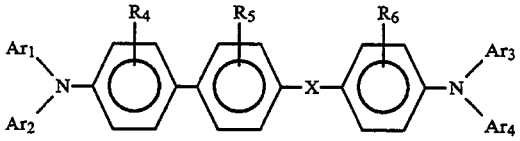

[III]

in which Ar–$Ar_4$ and X are the same as those in the formula [I] of claim 14; $R_4$–$R_6$ are respectively a hydrogen atom, an alkyl group, an alkoxy group or a halogen atom.

6. A photosensitive member of claim 1, in which a layer thickness of the charge transporting layer is within the range of 25–60 μm.

7. A photosensitive member of claim 1, in which a layer thickness of the charge generating layer is within the range of 4 μm or less.

8. A laminated-type photosensitive member which is installed in a copying system working at a circumferential speed of the surface of the photosensitive member of 250 mm/sec or more, in which a photosensitive layer comprises;

a charge generating layer and a charge transporting layer of 25 μm or more thickness containing a binder resin, an arylamine compound as a charge transporting material of 0.2–2 parts by weight on the basis of one part by weight of the binder resin, and an electron-accepting compound of 1–10 percent by weight to the charge transporting material, said electron accepting compound having an electron affinity of 0.85–1.0 eV, on an electrically conductive substrate.

* * * * *